US007594579B2

(12) United States Patent
Baker et al.

(10) Patent No.: US 7,594,579 B2
(45) Date of Patent: Sep. 29, 2009

(54) BULK BAG AND RIGID FORK LIFT TINE RECEIVING MEMBER COMBINATION

(76) Inventors: Gerald Lynn Baker, #50, 52442 Range Road 220, Ardrossan, Alberta (CA) T8E 5G9; Richard Stephen Michaels, 37 Otter Crescent, St. Albert, Alberta (CA) T8N 6Y6

( * ) Notice: Subject to any disclaimer, the term of this patent is extended or adjusted under 35 U.S.C. 154(b) by 434 days.

(21) Appl. No.: 10/532,752

(22) PCT Filed: Oct. 22, 2003

(86) PCT No.: PCT/CA03/01610

§ 371 (c)(1),
(2), (4) Date: Oct. 21, 2005

(87) PCT Pub. No.: WO2004/037680

PCT Pub. Date: May 6, 2004

(65) Prior Publication Data

US 2006/0144734 A1 Jul. 6, 2006

(30) Foreign Application Priority Data

Oct. 23, 2002 (CA) ..... 2409471

(51) Int. Cl.
*B65D 19/00* (2006.01)

(52) U.S. Cl. ..... 206/598; 206/599

(58) Field of Classification Search ..... 206/386, 206/595, 596, 597, 598, 599, 600
See application file for complete search history.

(56) References Cited

U.S. PATENT DOCUMENTS 2,159,622 A 5/1939 Sanford
3,165,078 A 1/1965 White
3,329,103 A 7/1967 Cohen
3,469,542 A 9/1969 Ahlenius
3,651,769 A 3/1972 Foley
3,695,187 A 10/1972 Weiss
3,858,526 A 1/1975 Lombard et al.

(Continued)

FOREIGN PATENT DOCUMENTS

CA 2205840 11/1995

(Continued)

OTHER PUBLICATIONS

"Four Way Pallets", Europal.net, Technical Aid : Four—way pallet, <http://www.europal.net/pallets/type/quatre_entrees.htm>, retrieved Apr. 15, 2006.

*Primary Examiner*—Jacob K Ackun, Jr.
(74) *Attorney, Agent, or Firm*—Christensen O'Connor Johnson Kindness PLLC

(57) ABSTRACT

A bulk bag (12) and rigid fork lift tine receiving member (18) combination. The combination includes a bulk bag (12) having a bottom (14) and a peripheral sidewall (16). Two rigid parallel-piped fork lift tine receiving members (18) are provided, each having an exterior surface with a tie receiving channel (26) extending across a bottom face (20) of the exterior surface. The fork lift tine receiving members (18) are tied with ties (28) to the bottom of the bulk bag (12). The ties (28) are positioned within the receiving channels (26), which protects them from wear as the fork lift tine receiving members (18) move across a floor.

1 Claim, 7 Drawing Sheets

U.S. PATENT DOCUMENTS 3,878,796 A 4/1975 Morrison
3,880,092 A 4/1975 Seeber et al.
3,880,286 A 4/1975 Wegener
3,942,654 A 3/1976 Warrick
4,029,023 A 6/1977 Rosewicz et al.
4,319,529 A 3/1982 Beal
D277,042 S 1/1985 Carter et al.
4,830,191 A 5/1989 Dijksman
5,044,502 A 9/1991 Hale
5,170,722 A 12/1992 Friesner et al.
D345,847 S 4/1994 Schuchard
5,307,935 A * 5/1994 Kemanjian ..... 206/554
5,367,960 A 11/1994 Schleicher
5,440,998 A 8/1995 Morgan, IV et al.
5,456,189 A 10/1995 Belle Isle
5,461,988 A 10/1995 Cummings et al.
5,507,237 A 4/1996 Barrow et al.
5,537,937 A 7/1996 Juvik-Woods
5,662,048 A 9/1997 Kralj
5,676,063 A 10/1997 Wallace
D387,557 S 12/1997 Provot
5,785,175 A 7/1998 Cholsaipant
5,794,543 A 8/1998 John et al.
5,809,905 A 9/1998 John et al.
5,836,254 A 11/1998 Johansson
6,041,719 A 3/2000 Vidal et al.
6,213,305 B1 4/2001 Baker et al.
6,263,807 B1 7/2001 Fox et al.
6,299,011 B1 10/2001 Rosenfeldt
D453,603 S 2/2002 Bray et al.
6,390,675 B1 * 5/2002 Jardine ..... 383/24
6,467,625 B2 10/2002 Baker et al.
D466,690 S 12/2002 Walsh
6,533,121 B1 3/2003 Ross
D473,052 S 4/2003 Dehenau
6,540,085 B1 * 4/2003 Davies ..... 206/597
D478,421 S 8/2003 Overholt et al.
D492,835 S 7/2004 Michaels et al.
6,926,144 B1 * 8/2005 Schnaars et al. ..... 206/386
6,935,500 B1 8/2005 Schnaars
6,938,558 B1 9/2005 Peres
7,025,208 B2 * 4/2006 Baker et al. ..... 206/599
2002/0011194 A1 1/2002 Lacabanne
2003/0005862 A1 1/2003 Halavais
2003/0235349 A1 12/2003 Richardson, Jr. et al.
2004/0025756 A1 2/2004 Baker et al.
2004/0159565 A1 8/2004 Von Merveldt
2004/0264814 A1 12/2004 Eisenbarth et al.

FOREIGN PATENT DOCUMENTS

CA 2310556 10/2001
DE 94 16 379 1/1995
EP 0 080 126 6/1983
EP 0 115 551 8/1984
GB 2 161 452 A 1/1986

* cited by examiner

BULK BAG AND RIGID FORK LIFT TINE RECEIVING MEMBER COMBINATION

FIELD OF THE INVENTION

The present invention relates to a bulk bag and rigid fork lift tine receiving member combination.

BACKGROUND OF THE INVENTION

U.S. Pat. No. 6,213,305 (Baker et al 2001) describes a bulk bag which has a pair of flexible sleeves depending from the bottom of the bulk bag. Rigid fork lift tine receiving members are inserted into the sleeves. This facilitates the insertion of fork lift tines into the fork lift tine receiving members, so that the bulk bag may be lifted by a fork lift.

Although beneficial results may be obtained through the use of the bulk bag and rigid fork lift tine receiving members, as described by Baker et al; after prolonged use the sleeves on the bottom of the bulk bag tend to become worn. This is due to the fact that the sleeves are frequently in contact with the floor.

SUMMARY OF THE INVENTION

What is required is a bulk bag and rigid fork lift tine receiving member combination which will have greater wear resistance.

According to the present invention there is provided a bulk bag and rigid fork lift tine receiving member combination. The combination includes a bulk bag having a bottom and a peripheral sidewall. Two rigid parallel-piped fork lift tine receiving members are provided, each having an exterior surface with a tie receiving channel extending across a bottom face of the exterior surface. The fork lift tine receiving members are tied with ties to the bottom of the bulk bag. The ties are positioned within the receiving channels. Further beneficial results may be obtained through the use of velcro ties.

With the combination, as described above, the ties used to secure the fork lift tine receiving members to the bottom of the bulk bag are protected from wear within the tie receiving channel as the bottom face of the fork lift tine receiving members move across a floor.

Although beneficial results may be obtained through the use of the combination, as described above, it is desirable to limit movement of the fork lift tine receiving members as much as possible. Even more beneficial results may, therefore, be obtained when adjacent side faces of the fork lift tine receiving members also have tie receiving channels. The tie receiving channels on the adjacent side faces help to limit movement of the fork lift tine receiving members. It is preferred that the tie receiving channel on the bottom face be substantially aligned with the tie receiving channels in the adjacent side faces.

There are two alternative approaches to providing the above described tie receiving channels. A first approach is to have the tie receiving channel or channels recessed relative to the exterior surface of the fork lift tine receiving member. A second approach is to have the tie receiving channel or channels raised so that they protrude from the exterior surface.

Although beneficial results may be obtained through the use of the combination, as described above, even more beneficial results may be obtained when the recessed tie receiving channel or channels are in the form of a dove-tail groove. This structure allows a tie, such as a belt, to be inserted into the groove in one orientation and resists the removal from the groove in another orientation.

Further beneficial results may be obtained through the use of slots positioned at the outward ends of the fork lift tine receiving members adapted to receive further ties.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
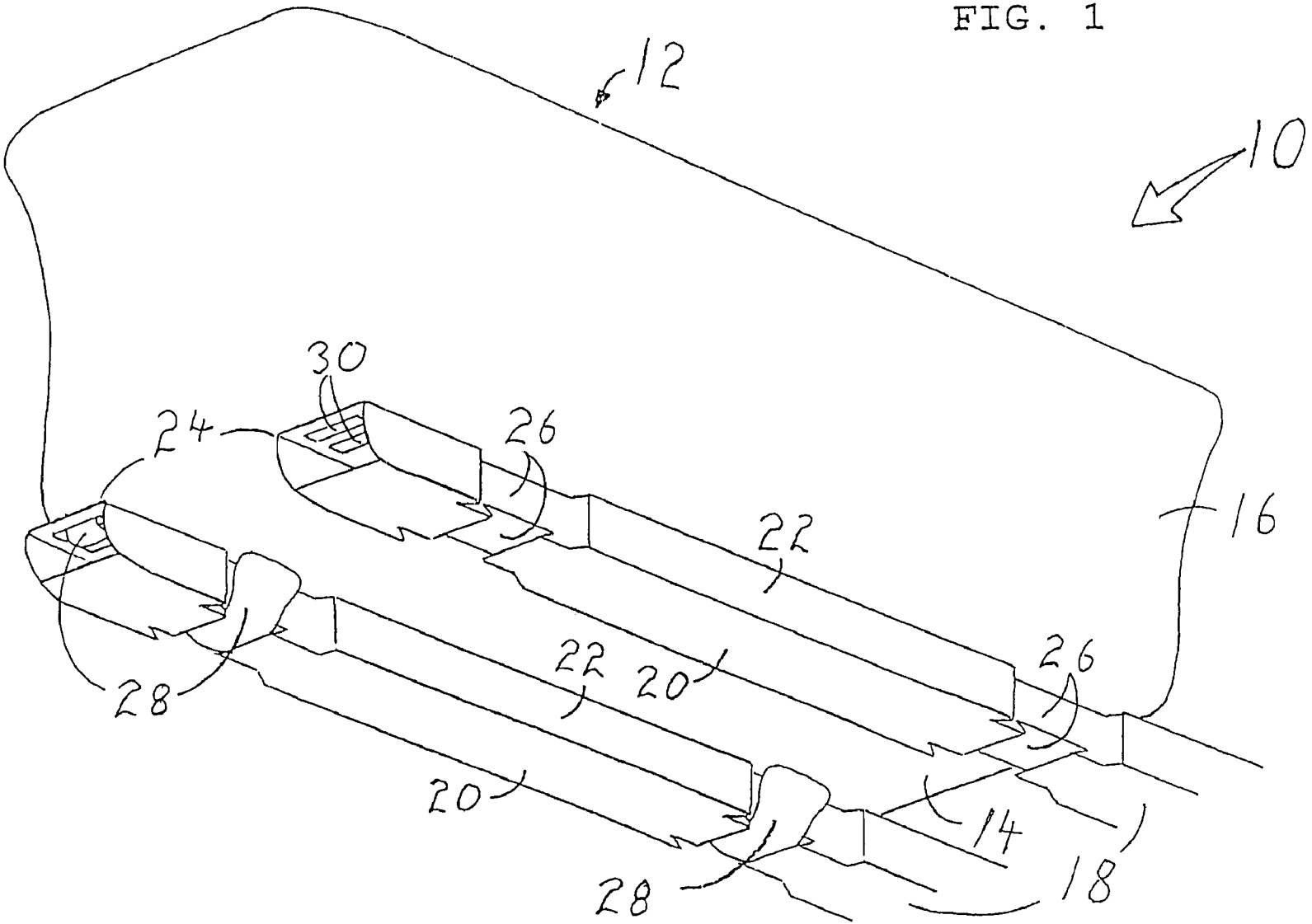
FIG. 1 is a perspective view of a bulk bag/fork lift tine retaining member combination constructed in accordance with the teachings of the present invention, having recessed tie receiving channels.

A first preferred embodiment of bulk bag/fork lift tine retaining member, generally identified by reference numeral 10, will now be described with reference to FIGS. 1 and 2. A second preferred embodiment of bulk bag/fork lift tine retaining member, generally identified by reference numeral 100, will now be described with reference to FIG. 3. A third preferred embodiment of bulk bag/fork lift tine retaining member, generally identified by reference numeral 200, will now be described with reference to FIG. 4. Variations on ties will now be described with reference to FIGS. 5 through 7.

Figure 2:
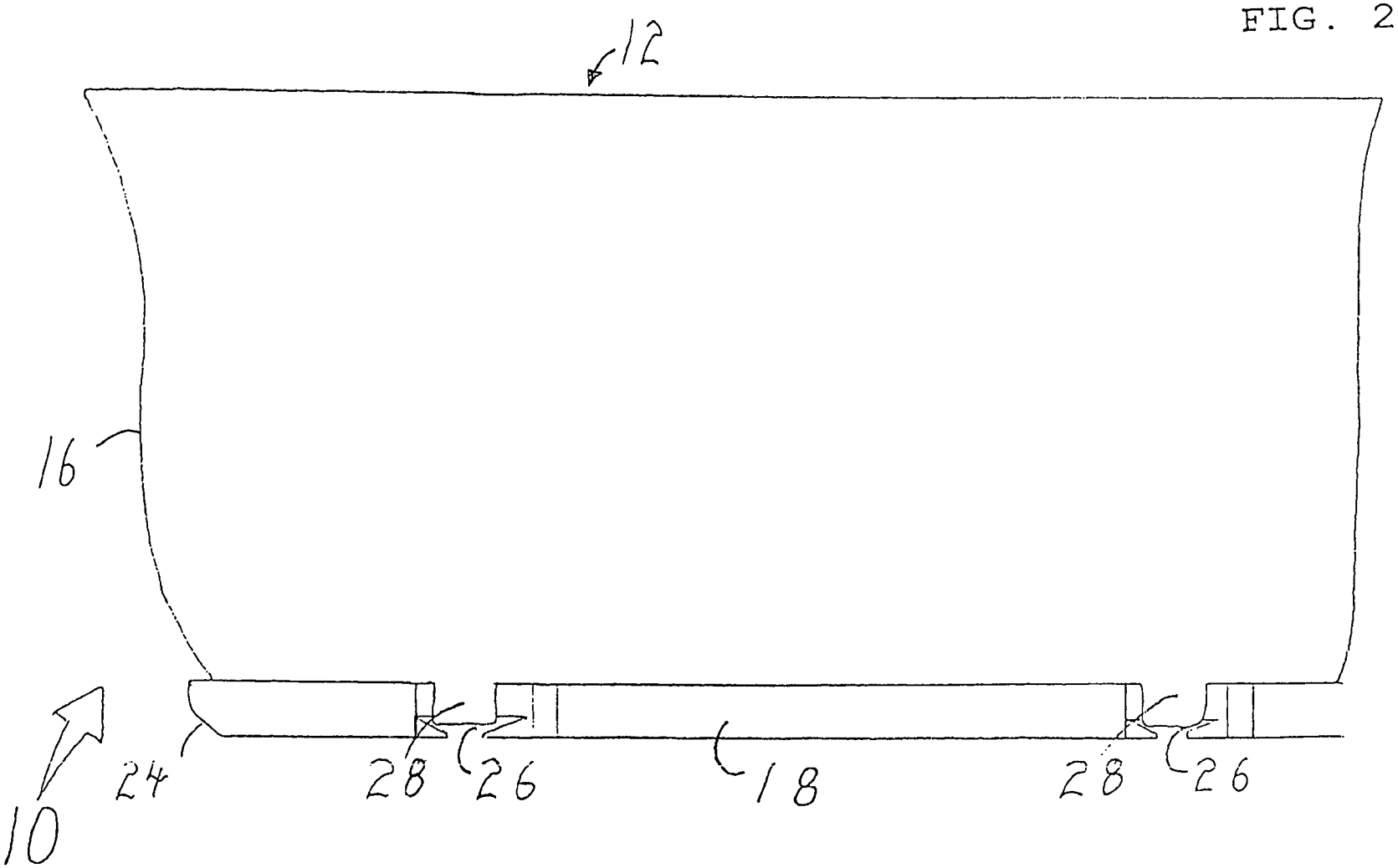
FIG. 2 is a longitudinal section view of the bulk bag/fork lift tine retaining member combination illustrated in FIG. 1.

Structure and Relationship of Parts of First Embodiment 10:

Referring to FIG. 1, bulk bag 12 has a bottom 14 and peripheral sidewall 16. Fork lift tine receiving members 18 each have a bottom face 20, side faces 22 and outward end 24. Bottom face 20 and side faces 22 each are adapted with recessed tie receiving channels 26. Referring to FIGS. 1 and 2, bulk bag 12 is adapted with ties 28 (one side here shown) which are positioned within recessed tie receiving channels 26. A pair of slots 30 are positioned on top at outward ends 24 to receive further ties (one shown) 28.

Operation:

The use and operation of a Bulk Bag and Rigid Fork Lift Tine Receiving Member Combination generally identified by reference numeral 10, will now be described with reference to FIGS. 1 through 2. Referring to FIG. 1, fork lift tine receiving members 18 are positioned under bulk bag 12 and fitted into ties 28 where ties 28 (one side here shown) are positioned within recessed tie receiving channels 26 such that movement of bulk bag 12 is controlled. Referring to FIGS. 1 and 2, all ties 28 shown are positioned within recessed tie receiving channels 26 and slots 30. The operation is especially facilitated where the recessed tie receiving channels 26, are dove-tailed. The dove-tailed channels contain the ties, so that they cannot be pulled laterally out of the channels.

Figure 3:
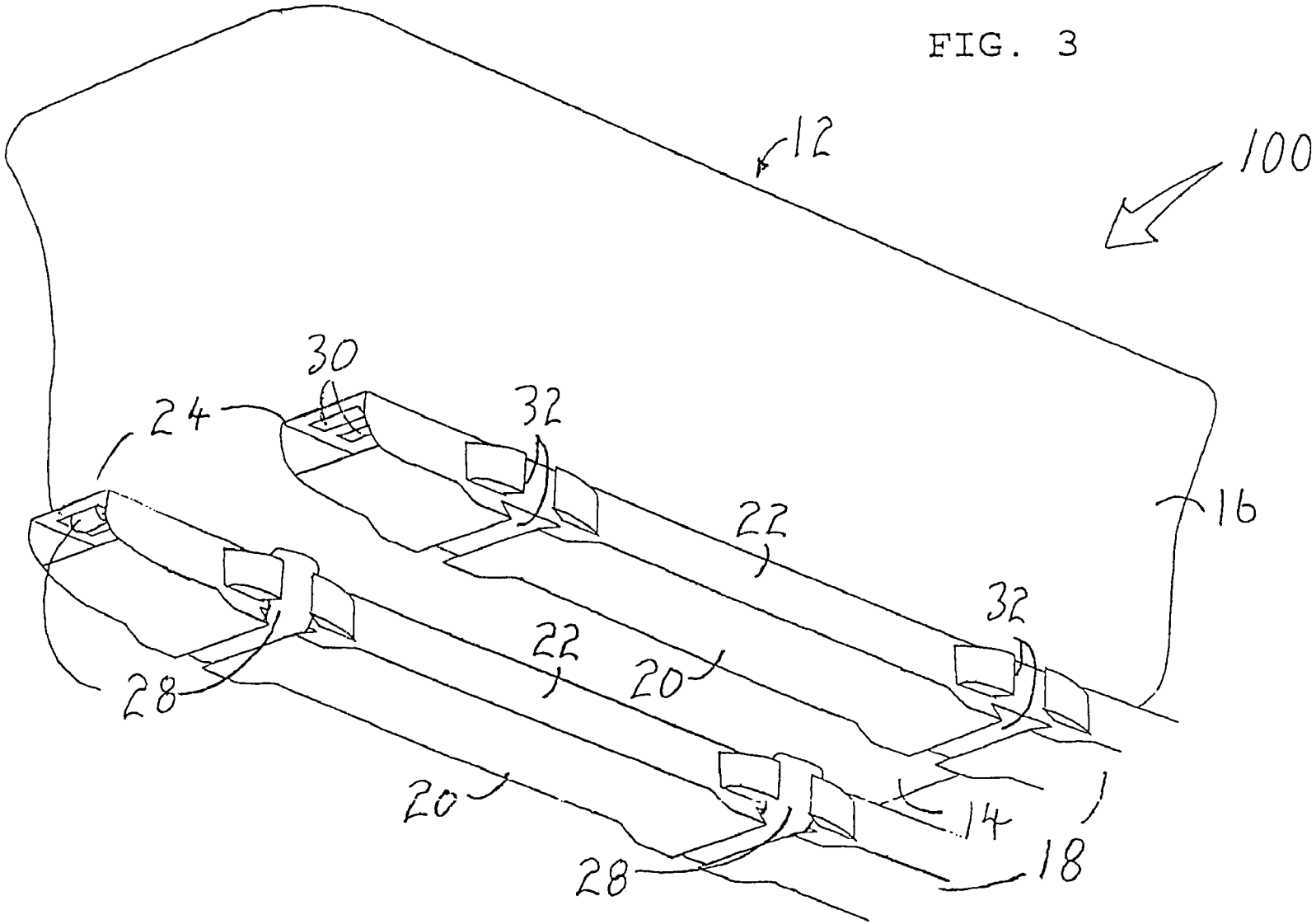
FIG. 3 is a perspective view of a bulk bag/fork lift tine retaining member combination constructed in accordance with the teachings of the present invention, having raised tie receiving channels.

Structure and Relationship of Parts of Second Embodiment 100:

Referring to FIG. 3, bulk bag 12 has a bottom 14 and peripheral sidewall 16. Fork lift tine receiving members 18, each having a bottom face 20 and side faces 22, are each adapted with raised tie receiving channels 32. Bulk bag 12 is adapted with ties 28 (one side here shown) which are positioned within raised tie receiving channels 32 and slots 30.

Operation:

The use and operation of a Bulk Bag and Rigid Fork Lift Tine Receiving Member Combination generally identified by reference numeral 100, will now be described with reference to FIG. 3. Fork lift tine receiving members 18 are positioned under bulk bag 12 and fitted into ties 28 (one side here shown) where ties 28 are positioned within raised tie receiving channels 32 and slots 30 such that movement of bulk bag 12 is controlled. As described above, the operation is especially facilitated where the raised tie receiving channels 32, are dove-tailed to laterally confine the ties.

Figure 4:
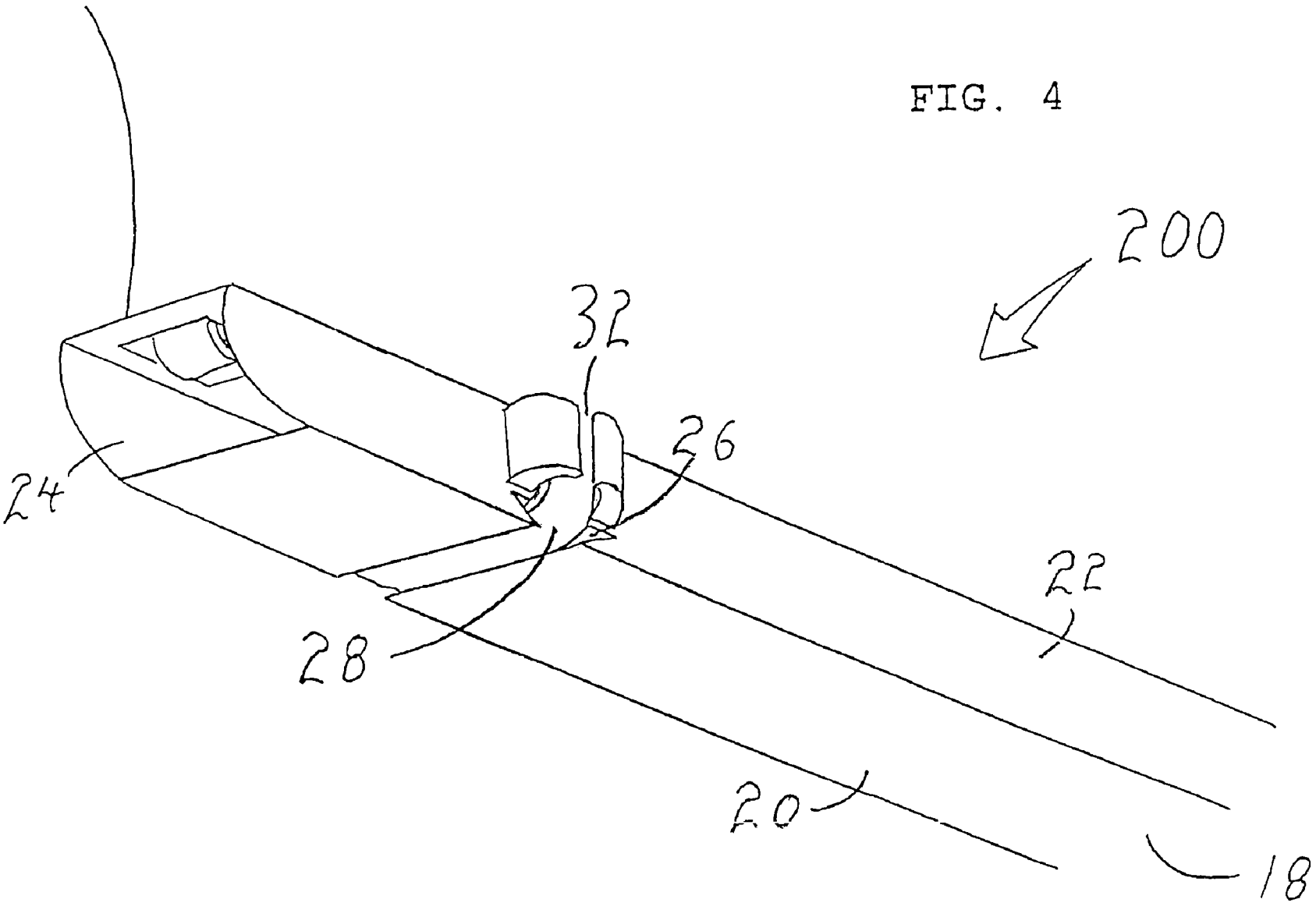
FIG. 4 is a detail, perspective view of a bulk bag/fork lift tine retaining member combination constructed in accordance with the teachings of the present invention, having a recessed bottom tie receiving channel and raised side tie receiving channels.

It is possible to combine the teachings of first embodiment 10 and second embodiment 100 to arrive at a third embodiment 200:

Structure and Relationship of Parts of Third Embodiment 200:

Referring to FIG. 4, fork lift tine receiving members 18, have a bottom face 20 and side faces 22. Bottom face 20 is adapted with recessed tie receiving channels 26. Each side face 22 is adapted with raised tie receiving channels 32. Bulk bag 12 is adapted with ties 28 (one here shown) which are positioned within each of recessed tie receiving channels 26 and raised tie receiving channels 32.

Operation:

The use and operation of a Bulk Bag and Rigid Fork Lift Tine Receiving Member Combination generally identified by reference numeral 200, is as previously outlined in regard to the previous embodiments.

Figure 5:
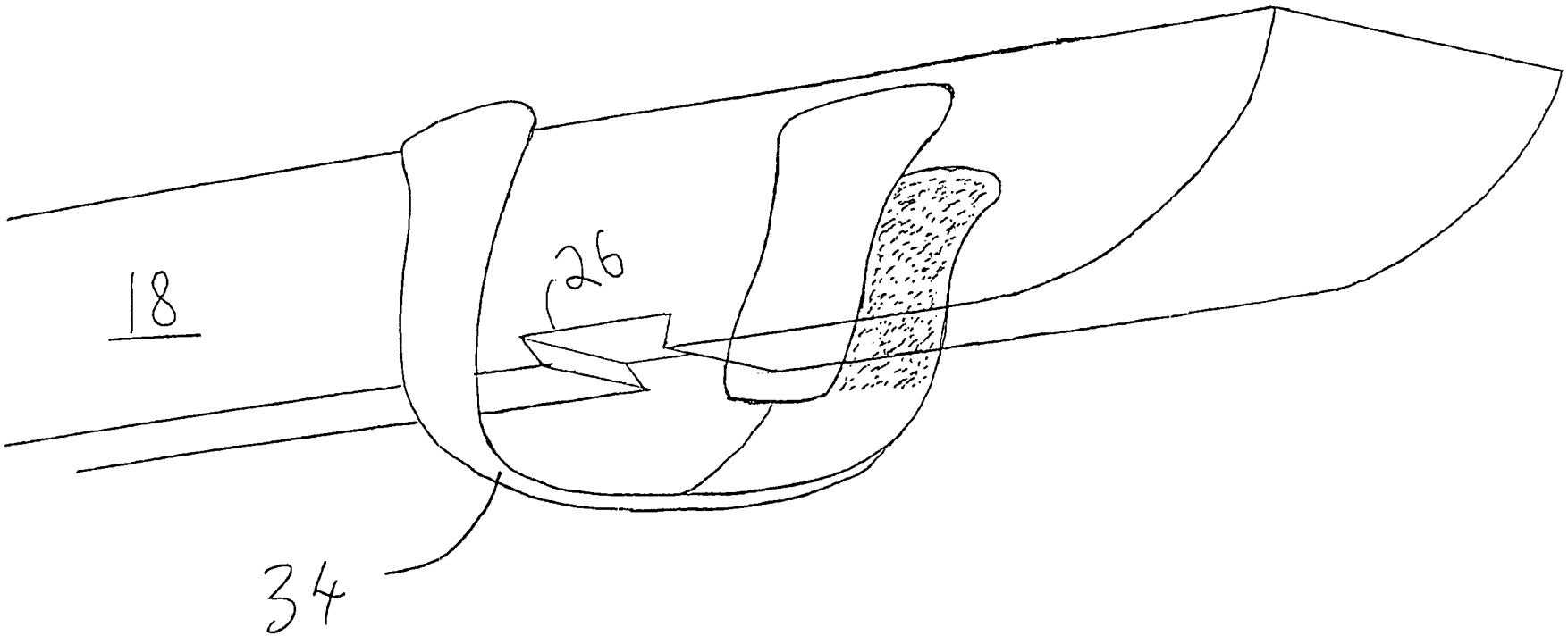
FIG. 5 is a detailed perspective view of a belt tie.
Figure 6:
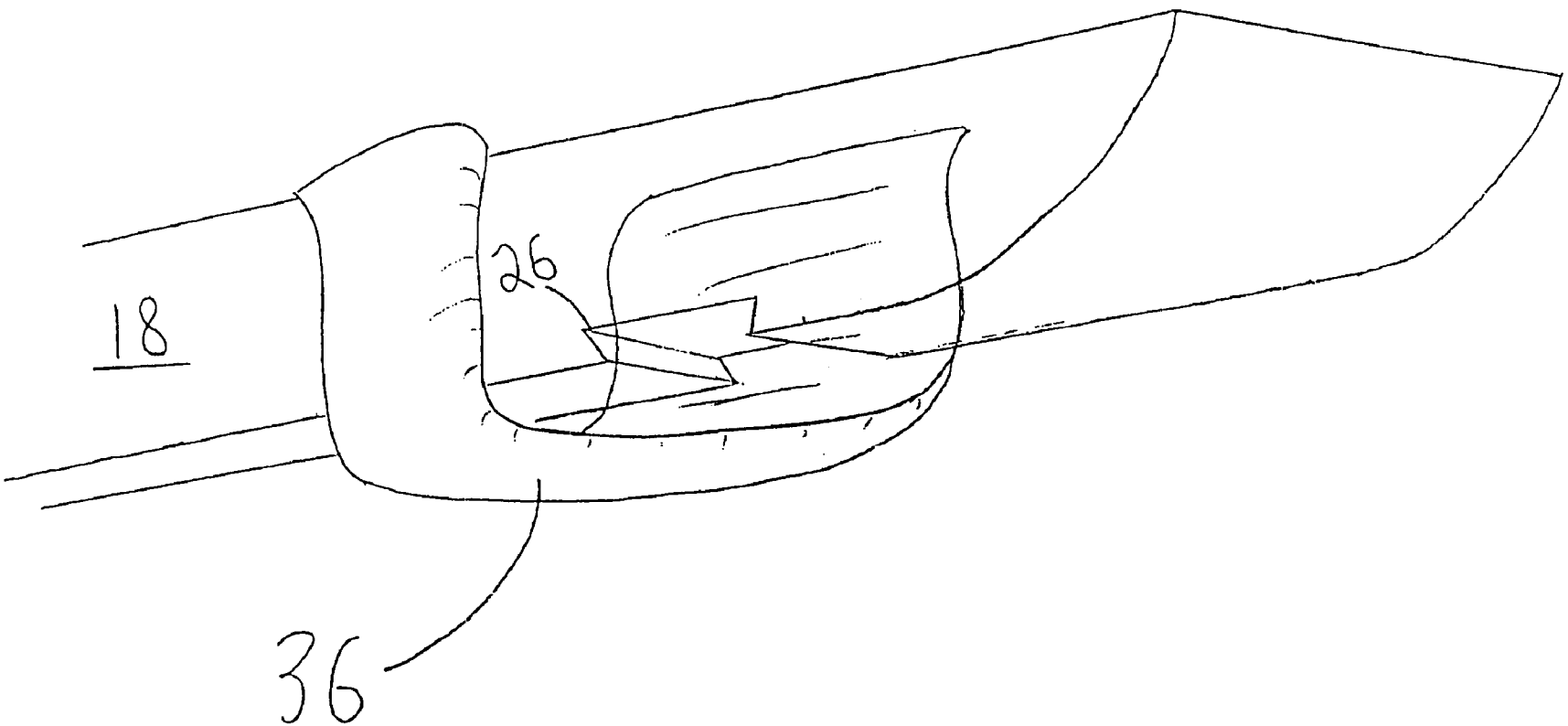
FIG. 6 is a detailed perspective view of an elasticized tie.

Variations:

The term "tie" is used as all encompassing term to cover all of the many possible variations. Referring to FIG. 5, it can be seen that the tie can be in the form of a belt 34. Belt 34 can be fastened together by any suitable fastener, such as a buckle or mating tape fastener. In the illustrated embodiment, a fastener such as are sold under the Trade Mark "VELCRO" is illustrated. Referring to FIG. 6, the tie can also be in the form of an elastic sleeve 36 which is stretched into position. Sleeve 36 can vary in width, from a relatively narrow sleeve of two to three inches, to a relatively width sleeve that extends for substantially the entire length of the fork lift tine receiving member, to a sleeve of intermediate width of six to twelve inches.

Figure 7:
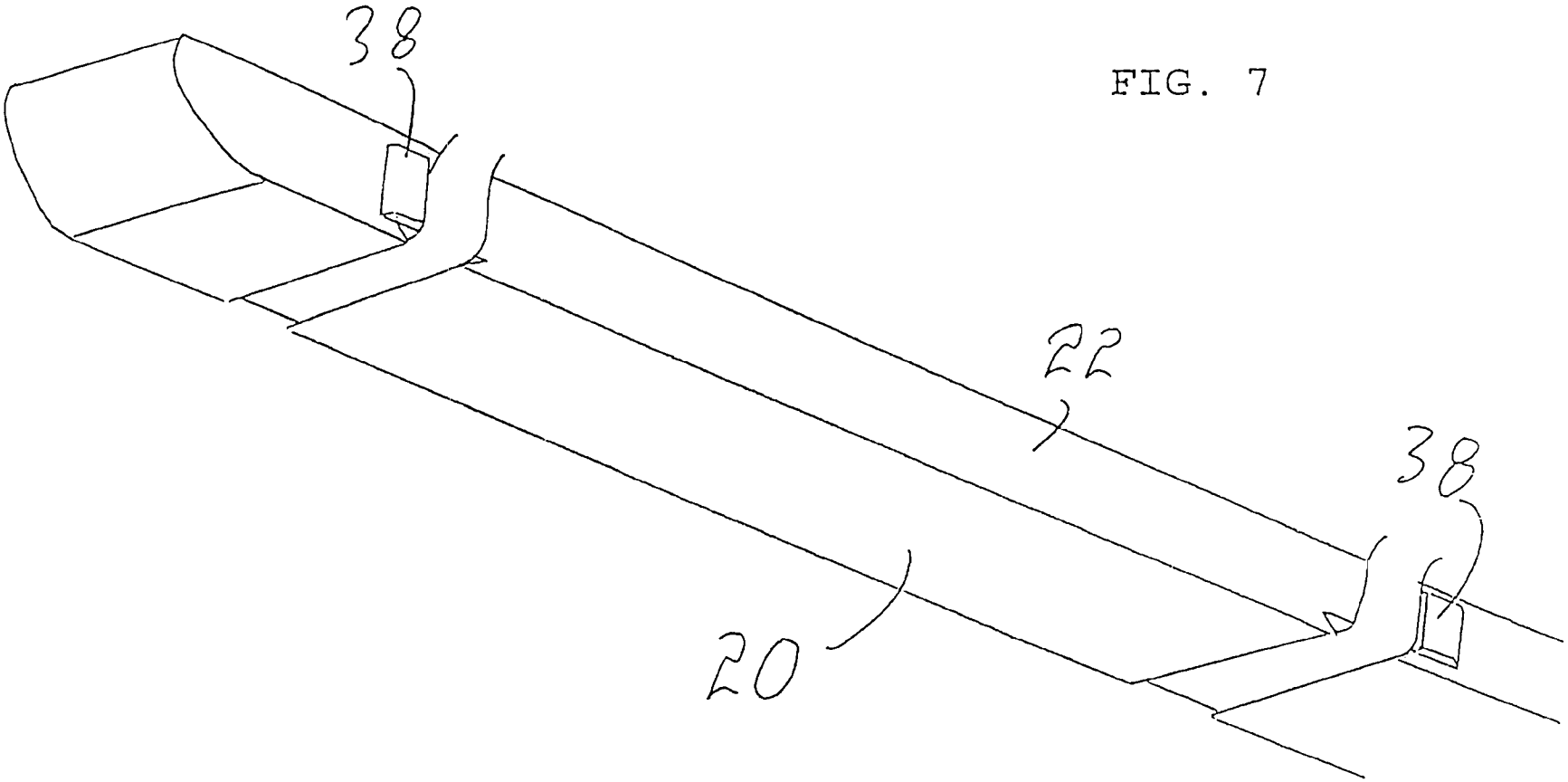
FIG. 7 is a perspective view of a fork lift tine receiving member with stops.

Further, receiving channels 32 on side faces 22 of fork lift tine receiving members 18 serve to limit relative axial movement between the ties and the fork lift tine receiving members. Referring to FIG. 7, it is possible to accomplish this same objective when fork lift tine receiving members 18 have side faces 22 with raised stops 38 which limit relative axial movement of the ties and fork lift tine receiving members 18 in one direction.

Operation:

The use and operation of the further variations of ties as outlined above is as previously outlined in regard to the previous use of ties.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. In combination:

a bulk bag having a bottom, a peripheral sidewall and ties attached to one of the bottom or the peripheral sidewall of the bulk bag;

two rigid parallel-piped fork lift tine receiving members having opposed ends, the fork lift tine receiving members underlying the bottom of the bulk bag;

securing means being provided to secure each of the opposed ends of the fork lift tine receiving members to the bulk bag thereby limiting movement of the fork lift tine receiving members in relation to the bottom of the bulk bag; and at least one of the securing means including a pair of axially spaced slots on top of each of the opposed fork lift tine receiving members at one of the opposed ends, the ties being threaded though the slots to secure the fork lift tine receiving members to the bulk bag.

* * * * *